US010390580B2

(12) United States Patent
Olsson et al.

(10) Patent No.: US 10,390,580 B2
(45) Date of Patent: Aug. 27, 2019

(54) AIRBAG SUITABLE FOR HEAD PROTECTION

(75) Inventors: Dick Olsson, Kungälv (SE); Ulf Sellergren, Helsingborg (SE)

(73) Assignee: HÖVDING SVERIGE AB, Malmö (SE)

( * ) Notice: Subject to any disclaimer, the term of this patent is extended or adjusted under 35 U.S.C. 154(b) by 257 days.

(21) Appl. No.: 13/823,986

(22) PCT Filed: Sep. 29, 2011

(86) PCT No.: PCT/SE2011/051163

§ 371 (c)(1),
(2), (4) Date: Apr. 17, 2013

(87) PCT Pub. No.: WO2012/044245

PCT Pub. Date: Apr. 5, 2012

(65) Prior Publication Data

US 2013/0276213 A1 Oct. 24, 2013

(30) Foreign Application Priority Data

Sep. 29, 2010 (SE) ..... 1051010

(51) Int. Cl.

| | |
|---|---|
| ***A42B 3/04*** | (2006.01) |
| ***A41D 13/05*** | (2006.01) |
| ***A42B 3/12*** | (2006.01) |

(52) U.S. Cl.

CPC ..... *A42B 3/0486* (2013.01); *A41D 13/0512* (2013.01); *A42B 3/122* (2013.01)

(58) Field of Classification Search

CPC .... A41D 13/0512; A41D 13/018; A42B 3/12; A42B 3/121; A42B 3/122; A42B 3/124; A42B 3/0486

See application file for complete search history.

(56) References Cited

U.S. PATENT DOCUMENTS

| | | | | | |
|---|---|---|---|---|---|
| 2,150,290 | A * | 3/1939 | Mulvey | A42B 3/12 | 2/413 |
| 3,600,714 | A * | 8/1971 | Cade | A42B 3/121 | 2/413 |
| 3,668,704 | A * | 6/1972 | Conroy | A42B 3/122 | 2/413 |
| 3,761,959 | A * | 10/1973 | Dunning | A42B 3/122 | 137/223 |

(Continued)

FOREIGN PATENT DOCUMENTS

| | | | | |
|---|---|---|---|---|
| CA | 1171602 | | 7/1984 | |
| DE | 19754541 | A1 * | 6/1999 | A41D 13/00 |

(Continued)

*Primary Examiner* — Megan E Lynch

(74) *Attorney, Agent, or Firm* — Capitol City TechLaw

(57) ABSTRACT

An airbag (20) for protecting the head of a user in case of an accident is hereby presented. The airbag comprises an inflatable inner bag (21, 40, 50, 60) surrounded by an outer bag (22), wherein the structure of the outer bag (22) defines the shape of the airbag (20) when the inner bag (21) is inflated, and wherein said inner bag (21, 40, 50, 60) comprises a plurality of elongate first chambers (28, 29, 210, 211, 41, 42, 43, 44, 45, 46, 47, 48, 65, 66, 69, 610, 611, 612, 613, 614), each of which elongate first chambers forms a head protective part when inflated.

10 Claims, 2 Drawing Sheets

(56) References Cited

U.S. PATENT DOCUMENTS 4,035,846 A * 7/1977 Jencks ..... A42B 3/122 2/413
4,354,284 A * 10/1982 Gooding ..... A42B 3/121 2/413
4,375,108 A * 3/1983 Gooding ..... A42B 3/121 2/413
4,551,858 A * 11/1985 Pasternack ..... A42B 3/121 2/171.2
4,686,710 A * 8/1987 Marston ..... A41D 13/0512 2/2.5
4,825,469 A * 5/1989 Kincheloe ..... A41D 13/018 2/16
4,853,980 A * 8/1989 Zarotti ..... A42B 3/285 2/413
4,881,529 A * 11/1989 Santos ..... A41D 13/0512 128/DIG. 23
4,977,623 A * 12/1990 DeMarco ..... A41D 13/018 2/456
4,997,623 A 3/1991 Brill
5,175,889 A * 1/1993 Infusino ..... A42B 3/122 2/413
5,263,203 A * 11/1993 Kraemer ..... A42B 3/122 2/413
5,402,535 A * 4/1995 Green ..... A41D 13/018 128/DIG. 23
5,745,923 A * 5/1998 Katz ..... A42B 3/00 2/411
5,890,232 A * 4/1999 Park ..... A42B 3/122 2/413
5,913,412 A * 6/1999 Huber ..... A42B 3/28 2/413
6,032,299 A 3/2000 Welsh
6,178,560 B1 * 1/2001 Halstead ..... A42B 3/122 2/413
6,230,333 B1 3/2001 Umeda
6,226,801 B1 * 5/2001 Alexander ..... A42B 3/122 2/413
6,585,293 B2 * 7/2003 Keshavaraj ..... B60R 21/23 280/729
6,857,136 B1 * 2/2005 Bradley ..... A41D 13/0125 2/102
6,883,826 B2 * 4/2005 Fujiwara ..... 280/730.2
6,912,735 B2 * 7/2005 Sacree ..... A42B 3/122 2/413
7,150,048 B2 * 12/2006 Buckman ..... 2/465
7,370,370 B2 * 5/2008 Colombo ..... 2/69
8,336,122 B1 * 12/2012 Harris ..... A42B 3/122 2/412
8,608,191 B2 * 12/2013 Dainese ..... A41D 13/018 280/730.1
2003/0140401 A1 * 7/2003 Ku ..... A42B 3/122 2/413
2004/0078877 A1 * 4/2004 Harty ..... A41D 13/0512 2/468
2004/0226077 A1 * 11/2004 Toth ..... A42B 3/10 2/411
2006/0107952 A1 * 5/2006 Schlosser ..... A41D 13/018 128/202.19
2010/0192290 A1 * 8/2010 Husain ..... A41D 13/0512 2/468
2011/0162131 A1 * 7/2011 Harty ..... A42B 3/0473 2/413
2012/0023648 A1 * 2/2012 Dainese ..... A41D 13/018 2/456
2012/0255099 A1 * 10/2012 Sternberg ..... A41D 27/18 2/84
2013/0205471 A1 * 8/2013 Alvarez ..... A41D 13/0512 2/202
2014/0020158 A1 * 1/2014 Parsons ..... A42B 3/122 2/413
2014/0331397 A1 * 11/2014 Kasahara ..... A61F 5/055 2/468

FOREIGN PATENT DOCUMENTS

GB 2352162 A 1/2001
JP 1991-014605 A 1/1991
JP 3060295 8/1999
WO 0154523 A1 8/2001
WO 2007050024 A1 5/2007
WO WO 2007050024 A1 * 5/2007 ..... A41D 13/018
WO 2010064057 A1 6/2010
WO 2010067289 A2 6/2010

* cited by examiner

AIRBAG SUITABLE FOR HEAD PROTECTION

TECHNICAL FIELD

The present disclosure relates to airbags. More specifically, the present invention relates to a wearable airbag for protecting a user's head.

BACKGROUND

Airbags for protection of a person's head are known in the art, for example through WO2007050024A1 and through WO01/54523A1.

In order to prevent whiplash injuries, the airbag of WO2007050024A1 is inflated in a two-step manner, first around the neck and back head region of a user to stabilize the neck, and then around the skull and crown part of the user's head to form a hood.

In order to prevent whiplash injuries it is of high importance that the airbag is inflated in a highly predictable manner, independently of external factors, such as the exact shape of the head of the user and/or the exact folding of the airbag prior to inflation.

Hence, improved control of the inflation of the airbag would be advantageous.

SUMMARY

An object is to provide an improved airbag for protecting the head of a user. A specific object is to provide an airbag enabling improved control of the inflation of the airbag around the user's head in case of an accident.

According to a first aspect, an airbag for protecting the head of a user in case of an accident is provided. The airbag comprises an inflatable inner bag surrounded by an outer bag, wherein the structure of the outer bag defines the shape of the airbag when the inner bag is inflated, and wherein said inner bag comprises a plurality of elongate first chambers, each of which elongate first chambers forms a head protective part when inflated.

The elongate first chambers may form protective parts for the frontal, parietal, and temporal lobes of the skull when inflated. Further, the elongate first chambers may form protective parts for the neck when inflated.

The inner bag may further comprise a second chamber interconnecting the first chambers, wherein said second chamber forms a neck protective part when inflated.

Said second chamber may further form a protective part for the occipital lobe of the skull when inflated.

The outer bag may comprise a plurality of lateral sections extending between predefined portions of the outer bag, and wherein each section is accommodating a first chamber such that the first chamber is prevented to move outside its associated section when inflated.

Said portions of the outer bag may be formed by means of seams.

The inner bag may comprise at least one passageway through a first or a second chamber.

Said at least one passageway may be formed as a non-inflatable part of a first or a second chamber.

Said portions of the outer bag may be attached to each other through said passageway.

Said sections may be formed by attaching a predefined portion of a first side of the outer bag with a predefined portion of a second side of the outer bag by means of seams, glue, or straps.

According to a second aspect, an airbag system is provided comprising an airbag according to the first aspect of the invention, and an inflation device configured to inflate fluid into the inner bag.

The inflation device may be configured to inflate fluid into the first chambers via the second chamber.

The airbag system may further comprise a triggering sensor configured to detect abnormal movement of a user corresponding to an accident, wherein said triggering sensor is capable of transmitting a triggering signal to said inflation device.

According to a third aspect, an apparel to be worn around the neck of a user is provided. The apparel comprises an airbag system according to the second aspect, wherein the airbag of said airbag system is folded within said apparel prior to inflation.

According to a fourth aspect, a method for providing an apparel for protecting the head of a user in case of an accident is provided. The method comprises the steps of providing an airbag system according to the second aspect, and folding the airbag of said airbag system within said apparel such that the elongate first chambers of said airbag are unfolded upon inflation in order to expand the airbag to cover the head of the user.

According to a yet further aspect, an airbag is provided. The airbag comprises an inner bag suitable for inflation. The inner bag is surrounded by an outer bag and the structure of the outer bag defines the shape of the airbag at inflation of the inner bag. Further, the inner bag comprises a plurality of separate elongate first chambers.

The inner bag may further comprise a second chamber interconnecting the first chambers.

The outer bag may comprise a section formed by attachment between portions of the outer bag, and wherein the section is suitable for incorporating at least one of said plurality of elongate first chambers.

The inner bag may comprise a passageway through a first or a second chamber.

Portions of the outer bag may be attached to each other through said passageway.

An elongate first chamber may be positioned within the outer bag in a position for expanding a neck portion of the outer bag.

In a further aspect, an airbag system is provided comprising the above described airbag and an inflation device configured to inflate fluid into the inner bag.

The inflation device may be configured to inflate fluid into the first chambers via the second chamber.

DETAILED DESCRIPTION

An idea is to provide a wearable airbag system for use instead of an ordinary rigid helmet, e.g. when bicycling.

Also, an idea is to provide a wearable airbag system being comfortable to wear. Furthermore, it is an idea to provide a wearable airbag system that does not obstruct vision or hearing when worn in its non-inflated state. Moreover, an idea is to provide a wearable airbag system being arranged such that it does not affect the user's hair style when worn. Preferably, the airbag system is enclosed within an apparel surrounding the neck of a user.

The following description focuses on embodiments applicable to a wearable airbag for protecting the head of a user in case of an accident. However, it will be appreciated that the invention is not limited to this application but may be applied to other applications wherein it is suitable to protect an object in case of an accident.

Figure 1:
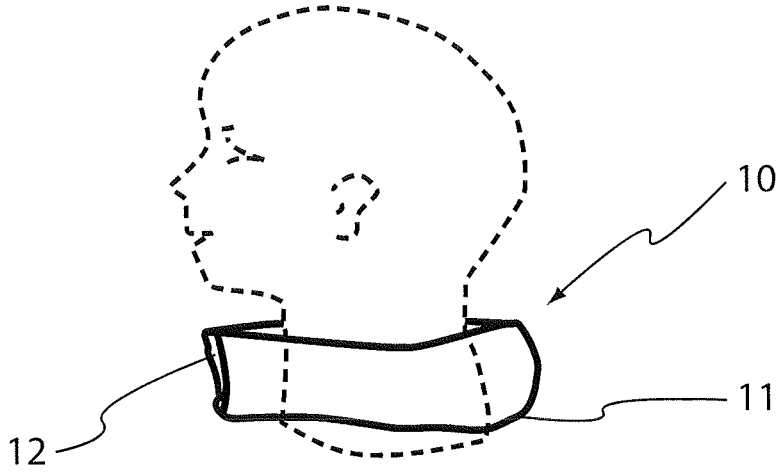
FIG. 1 shows an airbag according to an embodiment in its non-inflated state, worn by a user.

FIG. 1 shows an airbag system 10 according to an embodiment in its non-inflated state. The airbag system 10 is suitable for bicycle riders and is configured to be positioned around the neck of a user, in use. The airbag system 10 comprises an apparel 11. Thus, the apparel 11 functions as a collar intended to be worn on top of other clothes around the neck of a user as a preventive measure in case of an accident. The apparel 11 incorporates an airbag 20 for protecting the head region of the user in case of an accident.

As is shown in FIG. 1, the apparel 11 may comprise a joint portion provided with an interlocking means 12, such as a zipper, Velcro or releasable male/female connectors to connect the ends of the apparel together e.g. adjacently the users throat or neck region. The interlocking means 12 facilitates easy dressing and undressing of the apparel on the user.

The airbag system 10 may further comprise a detection device (not shown) configured to trigger inflation of the airbag by an inflation device upon detection of an accident situation. The inflation device may be any suitable type of airbag inflation device, such as an inflation device using solid fuel, such as pellets, or a so-called hybrid generator using a combination of compromised gas and solid fuel. In an embodiment, the inflation device is a cold gas inflator. The detection device is preferably configured to detect the movements of the user and, when determining that the user's movements correspond to an accident situation, to transmit a triggering signal to the inflation device. The airbag will consequently be inflated when the inflation device receives the triggering signal and is activated.

Figure 2:
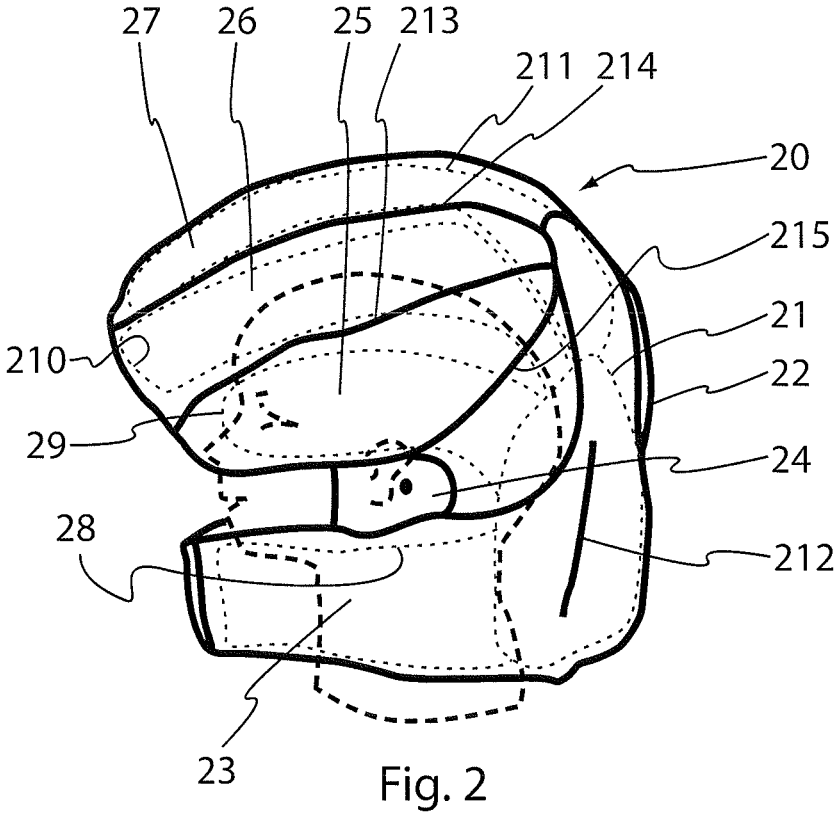
FIG. 2 shows an airbag according to an embodiment in a nearly fully inflated state.

FIG. 2 shows an airbag according to an embodiment in a nearly fully inflated state. In an embodiment, according to FIG. 2, the airbag 20 comprises an inner bag 21 suitable for inflation. The inner bag 21 is surrounded by an outer bag 22 and the structure of the outer bag 22 defines the shape of the airbag at inflation of the inner bag. Further, the inner bag 21 comprises a plurality of separate elongate first chambers 28, 29, 210, 211.

Figure 3:
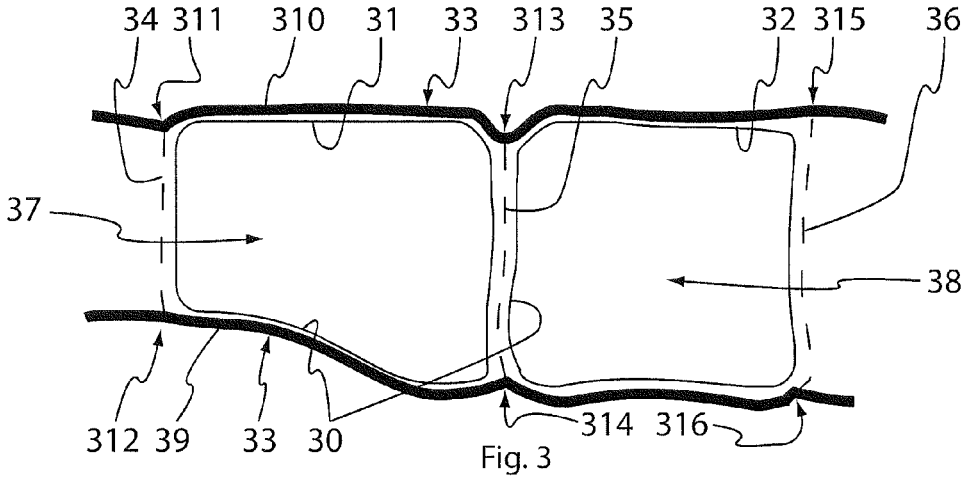
FIG. 3 shows a partial cross-sectional view of an airbag according to an embodiment in a nearly fully inflated state.

FIG. 3 shows a partial cross-sectional view of an airbag according to an embodiment in a nearly fully inflated state.

As shown in FIGS. 2 and 3, the airbag 20 comprises an inner bag 21, 30 (shown with thin dashed lines in FIG. 2) positioned inside an outer bag 22, 33 such that the inner bag 21, 30 is surrounded, or at least partially surrounded, by the outer bag 22, 33. Inflation of the inner bag 21, 30 leads to expansion of the outer bag 22, 33.

An outer bag 22 according to an embodiment of the invention is shown in an expanded state in FIG. 2. The outer bag 22 is made of a standard airbag material, such as polyamide. The outer bag 22 does not necessarily have to be fluid-impermeable, since the inner bag 21 is capable of expanding the outer bag 22.

According to an embodiment, the outer bag 22 comprises a plurality of sections 23, 24, 25, 26, 27 formed by attachment between portions 212, 213, 214, 215 of the outer bag 22. Each respective section 23, 24, 25, 26, 27 is suitable for incorporating at least one of a plurality of elongate first chambers 28, 29, 210, 211 of the inner bag 21 (to be further described below).

As previously mentioned, FIG. 3 shows a partial cross-sectional view of an airbag according to an embodiment in a nearly fully inflated state. The outer bag 33 comprises a plurality of layers 39, 310 of sheet material defining the inner volume of the bag 33. The layers 39, 310 may be formed by a single piece of sheet material folded in two, or by a plurality of pieces of sheet material joined together.

As shown in FIG. 3, sections 37, 38 may be formed in the outer bag 33 by joining together portions 311, 312, 313, 314, 315, 316 of a first 39 and a second 310 layer of the outer bag 33 by means of one or more straps 34, 35, 36 connecting the portions 311, 312, 313, 314, 315, 316.

As an alternative to using straps 34, 35, 36 for joining together said portions 311, 312, 313, 314, 315, 316 of the outer bag 33, the layers 39, 310 may be directly joined to each other by stitching or gluing.

Straps 34, 35, 36 may be utilized to provide improved control of distance between the layers 39, 310. A distance between the layers 39, 310 may for example be desirable in order to create a fluid filled volume suitable for absorbing a shock directed at the head of a wearer of said airbag.

Direct joining of portions 311, 312, 313, 314, 315, 316 of the outer bag 33 may be useful when sections 37, 38 with small cross-sectional area are desired. For example, a section 37, 38 with small cross-sectional area may be useful for quickly unfolding a portion of the airbag with a relatively low need of supplied fluid.

No matter what technique is used for creating the sections 37, 38, each section 37, 38 will get a maximum inner volume related to the cross-sectional area and length of the respective section 37, 38. The amount of fluid needed to fully expand/inflate each section 37, 38 relates to the maximum inner volume of the section 37, 38. Hence, the time needed for inflation of each respective section relates to its cross-sectional area.

Thus, as compared to having no sections, the sections 37, 38 bring about the technical effect that they allow for improved control of the size and shape of the airbag after expansion. Since each section 37, 38 has a maximum inner volume, certain sections 37, 38 may be fully expanded whilst at the same time other sections, for example the section 24 suitable for surrounding the ears, may be left non-expanded, or substantially non-expanded. An advantage of this is that individual control of the shape after expansion of individual sections 37, 38 and portions of the airbag 20 is made possible. Further, the formation of sections 37, 38 give improved control of the speed of expansion of different portions of the airbag.

As is illustrated in FIGS. 2 and 3, inflation of an elongated first chamber 28, 29, 210, 211, 31, 32 of the inner bag 21, 30 results in an expansion of a corresponding section 23, 24, 25, 26, 27, 37, 38 of the outer bag 22, 33, since each elongated first chamber is positioned within a corresponding section 23, 24, 25, 26, 27, 37, 38.

The cross-sectional area of each elongate first chamber 28, 29, 210, 211, 31, 32 may vary along the length of each first chamber. Typically, the cross-sectional area of each elongate first chamber 28, 29, 210, 211, 31, 32 is smaller than the cross sectional area of each respective section 23, 24, 25, 26, 27, 37, 38 around the first chamber 28, 29, 210, 211, 31, 32. This allows for the technical effect that a section 23, 24, 25, 26, 27 of the outer bag 22, 33 can be brought from a folded, non-inflated state to an unfolded, inflated state more quickly and with a relatively low volume of supplied air (as compared of directly inflating the outer bag 22, 33).

As previously mentioned, FIG. 3 shows a partial cross-sectional view of an airbag according to an embodiment in a nearly fully inflated state. The two elongate first chambers 31, 32 are expanded in two adjacent sections 37, 38 of the outer bag 33.

The material of the inner bag 30 may be chosen to be a highly elastic material, such as thermoplastic polyurethane film. This enables a first chamber 31, 32 to be suitably elastic to fill the full volume of a section 37, 38 upon inflation and thus to expand substantially all parts of the outer bag surrounding each respective section. This in turn enables a tighter and closer fit between the airbag and the head and neck of the person wearing the airbag, when the airbag is in its fully expanded state, since each section may be substantially fully expanded in all directions.

According to an embodiment, as shown in FIG. 2, the airbag 20 comprises a non-expandable section 24, e.g. provided adjacent to the ears of the user. The non-expandable section 24 may be provided for controlling the relative positions of other sections 23, 25, 26, 27 and portions of the airbag 20 during and after expansion of the airbag 20. Further, the non-expandable sections may be provided for protecting the user against scratches without blocking of the hearing of the user.

Thus, the structure of the outer bag 22 defines or sets the limit of the shape of the airbag 20 after inflation. Furthermore, the structure of the outer bag 22 controls the movement of the airbag 20 during inflation from a non-expanded state to an expanded state. Further, the provision of the sections 23, 24, 25, 26, 27 prevents the elongate chambers 28, 29, 210, 211 from moving outside its associated section both in a non-inflated or inflated state. Hence, the shape of the inflated airbag will be defined by the pre-arranged disposition of the sections 23, 24, 25, 26, 27 such that the inflated helmet will have a well-defined shape.

The inner bag 21 may be made of a fluid impermeable material, such as thermoplastic polyurethane film. Since fluid cannot easily leave a fluid impermeable bag, a person wearing an airbag 20 according to the invention will be protected by said airbag 20 for some time after expansion of the airbag 20, effectively protecting the head of the user for some time, such as when tumbling over after an accident. The inner bag 21 may be flexible and expandable such that it may expand the outer bag 22 upon inflation to a high pressure. Hence, the inner bag 21 may be inflated resulting in a relatively high internal pressure which may be maintained for some time.

In a preferred embodiment, the inner bag 21 is connected to the outer environment (i.e. atmospheric pressure) via an evacuating means for continuously allowing enclosed fluid to escape from the inner bag 21 when inflated. The evacuating means may be designed to be active, i.e. a valve opening upon a predetermined pressure or elapsed time, or passive, i.e. a channel allowing fluid to escape as soon as the inner bag 21 is subject to an increased pressure. The evacuating means may further be constructed such that the evacuating rate allows a certain pressure providing sufficient protection to a user to be maintained for a specific time after inflation, e.g. 2 seconds. The time for maintaining the protective pressure is preferably adjusted such that the inner bag, when inflated, provides protection during a complete accident sequence, but allows facilitated handling after an accident. Depending on the particular evacuation time, the evacuating means may be a hollow channel extending from the interior of the inner bag 21 to the outer environment, said channel having an interior diameter of approximately 0.5 to 1 mm.

Figure 4:
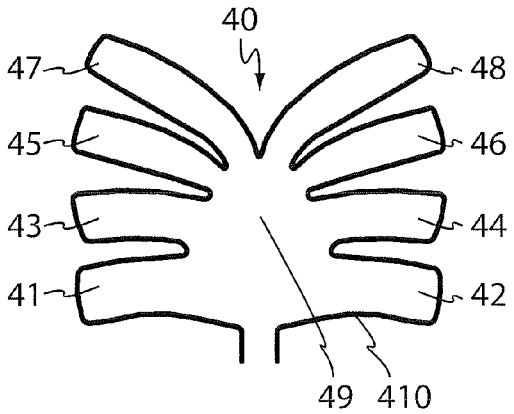
FIG. 4 shows an inner bag according to an embodiment in a non-inflated state laid out flat.

FIG. 4 shows an inner bag 40 according to an embodiment in a non-inflated state laid out flat. The inner bag 40 comprises a plurality of separate elongate first chambers 41, 42, 43, 44, 45, 46, 47, 48. The inner bag 40 also comprises a second chamber 49 interconnecting the first chambers 41, 42, 43, 44. The second chamber 49 at least serves to distribute fluid between the first chambers 41, 42, 43, 44 and the second chamber 49 such that an efficient and controlled inflation of the inner bag 40 may be performed.

The first chambers 41, 42, 43, 44, 45, 46, 47, 48 are positioned and shaped to be inserted into sections of an outer bag, such as the outer bag 22 shown in FIG. 2, for expanding said sections. For example, some of the first chambers 41, 42 may be positioned and shaped for expanding one or more sections of the outer bag suitable for surrounding and stabilizing the neck of a user after expansion, whilst other ones of the first chambers 43, 44, 45, 46, 47, 48 may be configured to expand one or more sections suitable for surrounding a crown part and/or forehead part of a user's head. This means that the elongate first chambers 43, 44, 45, 46, 47, 48 forms protective parts for the frontal, parietal, and temporal lobes of the skull when inflated.

Also, the second chamber 49 is positioned and shaped for expanding a back head portion of an airbag according to the invention, in order to further protect and stabilize the neck of the user. This means that the second chamber 49 forms a protective part for the neck as well as the occipital lobe of the skull when inflated.

The inner bag 40 may be formed by joining layers of a flexible film material to each other along one or more lines or curves 410, for example by welding or gluing. The inner bag 40 could also be made of a single sheet of film material folded in two layers before joining along the lines 410.

Figure 5:
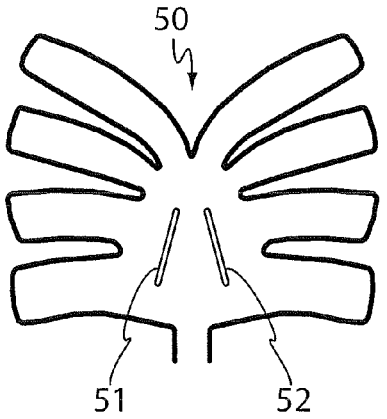
FIG. 5 shows an inner bag according to an embodiment in a non-inflated state laid out flat.

FIG. 5 shows an inner bag according to an embodiment in a non-inflated state laid out flat. The inner bag 50 comprises one or more passageways 51, 52. The passageways 51, 52 may be formed by welding portions of the inner bag 50 to each other. Subsequently, material may either be removed from the welded area to form a hole, or the material can be left in place to form an area which may be penetrated by needle and thread without causing fluid leakage from within the inner bag 50. The passageways 51, 52 should in this context be interpreted as paths through the inner bag 50, which paths may be used to guide any substance without causing fluid to leak out from said inner bag 50.

The passageways 51, 52 allow external objects or material to pass through the inner bag 50 without causing fluid leakage from within the inner bag 50. For example, this allows material of an outer bag, such as the outer bag 22 shown in FIG. 2, to pass through said passageway for loosely securing/positioning the inner bag 50 within the outer bag. Further, it allows sections to be formed in the outer bag by attachment between portions 212 of the outer bag through said passageway/passageways.

Figure 6:
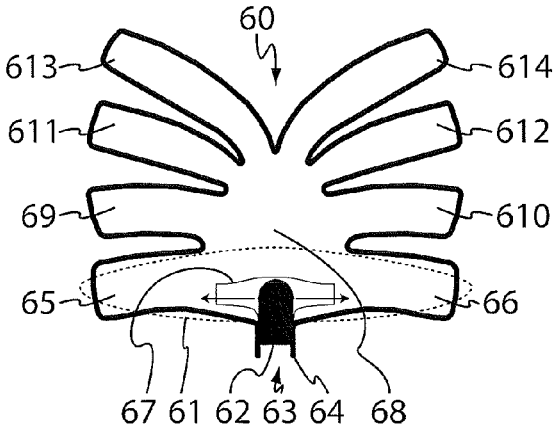
FIG. 6 shows an inner bag according to an embodiment in a non-inflated state laid out flat, in conjunction with an inflation device and a protective sleeve.

FIG. 6 shows an inner bag according to an embodiment in a non-inflated state laid out flat, in conjunction with an inflation device and a protective sleeve. The inner bag 60 comprises a neck portion 61 (encircled by a dotted line) suitable for expanding a neck portion of an outer bag, such as the outer bag shown in FIG. 2. The inner bag 60 is adapted for receiving an inflation device 62 by the provision of an opening 63.

According to an embodiment, the opening 63 is surrounded by a sealing portion 64 for sealing against the inflation device 62. Here, a hose clip, or the like, may be used to press the sealing portion against the inflation device 62 so that no fluid can escape through the opening 63 of the inner bag 60.

According to another embodiment, there is no opening in the inner bag and instead the inflation device is positioned entirely within the inner bag, wherein the inner bag is sealed around the inflation device.

Upon activation, the inflation device 62 inflates fluid into the inner bag 60, preferably into the neck portion 61 of the inner bag 60.

As shown in FIG. 6, the inflation device 62 may be positioned to inflate fluid in two opposite directions from a central region of the neck portion 61 in directions straight into first elongate first chambers 65, 66 of the neck portion 61 of the inner bag 60.

In this way, rapid inflation of the neck portion 61 of the inner bag 60 is promoted, thereby enabling rapid expansion of the neck portion of an airbag according to the invention.

As shown in FIG. 6, an airbag according to an embodiment comprises a T-shaped protective sleeve 67 provided around the inflation device in order to protect the inner bag 60 from hot and harsh fluid streams leaving the inflation device 62. The protective sleeve 67 also helps guiding the fluid leaving the inflation device 62. Suitable materials for the protective sleeve 67 are for example uncoated, or silicon coated, polyamide materials, which are inexpensive, flexible and heat resistant.

A second chamber 68 may be positioned centrally of the neck portion 61, such that a back head portion of the airbag may be expanded by the second chamber 68. This enables controlled symmetric expansion of the airbag, corresponding to the symmetry of the head of a user of the airbag, thereby providing for even and predictable inflation of the airbag. Further, such an arrangement of the second chamber 68 enables improved stabilization of the back head by expansion of a the back head portion of the airbag.

When a fluid pressure upon inflation starts to build up in the second chamber 68, the second chamber 68 gradually unfolds and eventually fluid may start to flow from the second chamber 68 and into each respective elongate first chamber 65, 66, 69, 610, 611, 612, 613, 614.

Unfolding and expansion of the airbag starts with inflation of the neck portion 61 of the inner bag 60. This expands the neck portion 61 of the airbag.

Once the neck portion 61 of the airbag is expanded, the pressure in the neck portion 61 of the inner bag 60 rises, wherein the second chamber 68 further unfolds and expands. Thereafter, or gradually during inflation of fluid into the second chamber 68, the rest of the inner bag 60 inflates. If surrounding parts of the airbag, such as protective/decorative cloth, are not open to allow the airbag to easily expand, seams, or the like, are dimensioned and arranged such that the surrounding parts of the airbag rupture in a controlled way due to the inner pressure caused by the expanding inner bag 60.

Altogether, this leads to inflation of the inner bag 60 from the neck portion 61, upwards around the back head, and further forward around the crown part of the head towards the forehead region of the person wearing the airbag.

The pressure in the second chamber 68 is high already in the early moments of an accident, even though the airbag 20 is not fully inflated and fluid still flows from the second chamber 68 and into surrounding elongate first chambers. Since surrounding elongate first chambers 65, 66, 69, 610, 611, 612, 613, 614 and material of the inner 60 and outer 22 bag are at least partially folded and therefore require both time and work to unfold and allow expansion by inflation of fluid. Therefore, the neck portion of the airbag 20 is expanded early and able to act to prevent whiplash injuries at an early moment of an accident even if the airbag 20 is not fully unfolded and inflated.

During unfolding of the second chamber 68, inflated fluid flows from the neck portion 61 of the inner bag 60 and into the second chamber 68. Hence, inflated fluid typically reaches elongate first chambers 69, 610 close to the neck portion 61 first and other elongate first chambers 611, 612, 613, 614 later on. The inflation order of each elongate first chamber 65, 66, 69, 610, 611, 612, 613, 614 may thus be controlled by varying, relative to the second chamber 68, the position of each respective elongate first chamber 65, 66, 69, 610, 611, 612, 613, 614 and the size of its fluid connection/inlet to the second chamber 68.

By varying the dimensions of each fluid connection/inlet between the second chamber 68 and each respective elongate first chamber 65, 66, 69, 610, 611, 612, 613, 614, the fluid flow into each respective elongate first chamber 65, 66, 69, 610, 611, 612, 613, 614 may be controlled, thereby enabling improved control of the speed of inflation of each respective elongate first chamber 65, 66, 69, 610, 611, 612, 613, 614. Thus, this provides for improved control of the expansion of the airbag.

The inflation of the inner bag and the unfolding of the airbag is preferably a sequential process, in which three main phases will be discussed. Upon inflation, the airbag is firstly unfolded to form a shape corresponding to a protective helmet. At this point, the airbag has a certain pressure for causing the unfolding and shaping of the helmet, but still not enough pressure for providing sufficient protection. Such first step is preferably performed within approximately 50 ms from the start of the inflation. As a second step, the pressure within the inner bag of the airbag is built up to a protective pressure, i.e. a pressure providing sufficient protection for a user. Typically, the time for achieving this pressure is about 100-150 ms from the start of the inflation. As the inflation process is still running, the pressure within the inner bag will increase up to a maximum pressure, which typically is provided after about 300 ms from the start of the inflation. Due to the provision of the evacuation means describes above the pressure will then decrease, however at a much lower rate such that the minimum required protective pressure is maintained for a predetermined time, e.g. 2 seconds.

During inflation of the inner bag 60, each elongate first chamber 65, 66, 69, 610, 611, 612, 613, 614 functions to unfold and expand a portion of the outer bag and by guiding inflated fluid towards and into each respective portion of the outer bag in a controlled manner.

The formation of finger-like elongate first chambers makes it possible to insert the inner bag into the outer bag after manufacturing of the outer bag, or at least by the last steps of manufacturing of the outer bag. This is of advantage since needles are typically used during manufacturing of the outer bag, and since use of needles typically increase the risk puncturing the inner bag.

Using an inner bag for expanding the outer bag, instead of just inflating the outer bag directly, makes it possible to expand only selected portions of the outer bag, and also to better control the order and speed in which the portions are inflated. As previously mentioned, the outer bag can be brought from a folded state to an unfolded state more quickly and reliable by means of the elongate first chambers.

Within the scope of the invention, the inner bag could also be a combination of separate bags which act together to achieve the intended controlled inflation. Also within the scope of the invention, each of the above described chambers could be modified by dividing the chamber into sub chambers or by combining chambers, as long as its function remains substantially intact. For example, the second chamber could be split into two partial chambers which could each be combined with one or more of the elongate first chambers.

The invention claimed is:

1. An airbag system for protecting the head of a user in case of an accident, the airbag system comprising:

a collar configured to be worn around a neck of a user, such that the collar is configured to encircle the neck and leaves a head exposed; and an airbag including an inflatable inner bag provided in an interior of an outer bag, the outer bag having an inner layer and an outer layer;

wherein the airbag is folded within the collar prior to inflation;

wherein the structure of the outer bag defines the shape of the airbag when the inner bag is inflated to a shape corresponding to a protective helmet;

wherein the structure of the outer bag controls movement of the airbag during inflation from a non-expanded state to an expanded state corresponding to the symmetry of the head of a user;

wherein the inner bag includes a plurality of elongate first chambers, each of the elongate first chambers having a closed distal end that is separated from the closed distal ends of the other elongate first chambers, each of the elongate first chambers forming a head protective part when inflated, and a second chamber interconnecting the elongate first chambers, the second chamber forming a neck protective part when inflated, the second chamber being provided in the interior of the outer bag;

wherein the outer bag includes a plurality of sections formed by attachments;

wherein the attachments join together the inner layer and the outer layer of the outer bag, extend through the interior of the outer bag, and extend between the elongate first chambers, such that a first section is formed between a first attachment and a second attachment, and a second section is formed between the second attachment and a third attachment;

wherein the first attachment is spaced apart from the second and the third attachments, and the second attachment is spaced apart from the third attachment;

wherein each section of the outer bag accommodates at least one of the elongate first chambers of the inner bag;

wherein the attachments are not fixed to the inner bag;

wherein the elongate first chambers form protective parts configured to protect frontal, parietal, and temporal lobes of a skull when inflated;

wherein the elongate first chambers further form protective parts configured to protect the neck when inflated; and wherein an inflation device is connected to the inner bag and configured to inflate fluid into the inner bag.

2. The airbag system according to claim 1, wherein the second chamber further forms a protective part configured to protect an occipital lobe of the skull when inflated.

3. The airbag system according to claim 1, wherein some of the sections of the outer bag are lateral sections extending between predefined portions of the outer bag.

4. The airbag system according to claim 3, wherein the predefined portions of the outer bag are formed by seams.

5. The airbag system according to claim 1, wherein the inner bag comprises at least one passageway through one or more of the elongate first chambers or the second chamber.

6. The airbag system according to claim 5, wherein the at least one passageway is formed as a non-inflatable part of one of the elongate first chambers or the second chamber.

7. The airbag system according to claim 3, wherein the predefined portions of the outer bag are attached to each other through at least one passageway through one or more of the elongate first chambers or the second chamber.

8. The airbag system according to claim 3, wherein the predefined portions of the outer bag include a predefined portion of the inner layer of the outer bag and a predefined portion of the outer layer of the outer bag; and wherein the lateral sections are formed by attaching the predefined portion of the inner layer of the outer bag with the predefined portion of the outer layer of the outer bag via seams, glue, or straps.

9. The airbag system according to claim 1, wherein the inflation device is configured to inflate fluid into the elongate first chambers via the second chamber.

10. The airbag system according to claim 1, further comprising a triggering sensor configured to detect abnormal movement of a user corresponding to an accident, upon which the triggering sensor transmits a triggering signal to the inflation device.

* * * * *